US006612320B2

(12) United States Patent
Lin et al.

(10) Patent No.: US 6,612,320 B2
(45) Date of Patent: Sep. 2, 2003

(54) ECONOMIC DOUBLE-STORY UMBRELLA AS CONVENIENTLY ANCHORED

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 0 days.

(21) Appl. No.: 09/878,418

(22) Filed: Jun. 12, 2001

(65) Prior Publication Data

US 2002/0185167 A1 Dec. 12, 2002

(51) Int. Cl.[7] ..... A45B 15/00; A45B 25/20

(52) U.S. Cl. ..... 135/33.41; 135/33.7; 135/98; 248/171; 248/156; 248/545

(58) Field of Search ..... 135/16, 33.7, 33.2, 135/33.41, 98, 99, 119, 120.3; 248/156, 169, 170, 171, 545, 188.6

(56) References Cited

U.S. PATENT DOCUMENTS 369,493 A * 9/1887 Averill ..... 135/114
1,525,701 A * 2/1925 Rose et al. ..... 248/170
4,753,411 A * 6/1988 Lechner et al. ..... 248/156
5,078,166 A * 1/1992 Lee ..... 135/33.7
5,137,236 A * 8/1992 Burns ..... 248/169
5,293,889 A * 3/1994 Hall et al. ..... 135/16
5,368,055 A * 11/1994 Johnson et al. ..... 135/33.41
6,089,244 A * 7/2000 Ko ..... 135/29
6,173,724 B1 * 1/2001 You ..... 135/15.1

FOREIGN PATENT DOCUMENTS

FR 2664137 * 10/1992

* cited by examiner

*Primary Examiner*—Lanna Mai
*Assistant Examiner*—Winnie Yip
(74) *Attorney, Agent, or Firm*—Troxell Law Office PLLC

(57) ABSTRACT

A double-story umbrella includes an upper umbrella formed by an upper umbrella cloth; a lower umbrella having a shaft and a rib assembly pivotally secured to the shaft for securing a lower umbrella cloth on the rib assembly; a plurality of detachable restorable buckling devices each coupling the upper umbrella cloth with the lower umbrella cloth; and a supporting device adjustably detachably secured on a lower portion of the shaft and operatively anchored on or under a ground for stably erecting the shaft and the double-story umbrella.

6 Claims, 9 Drawing Sheets

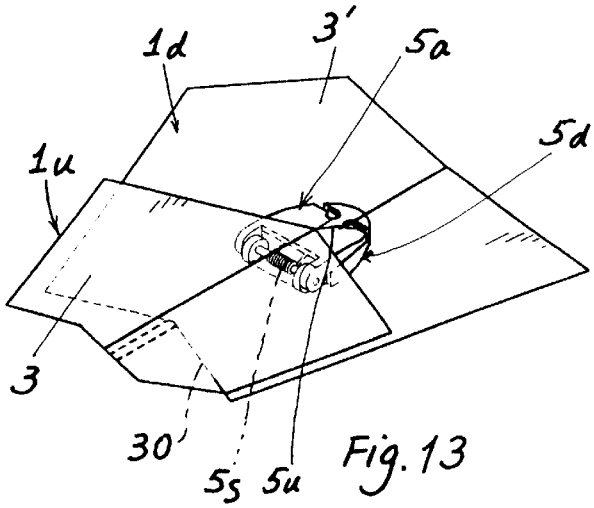
Fig. 13
Fig. 15
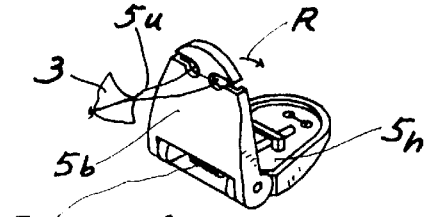
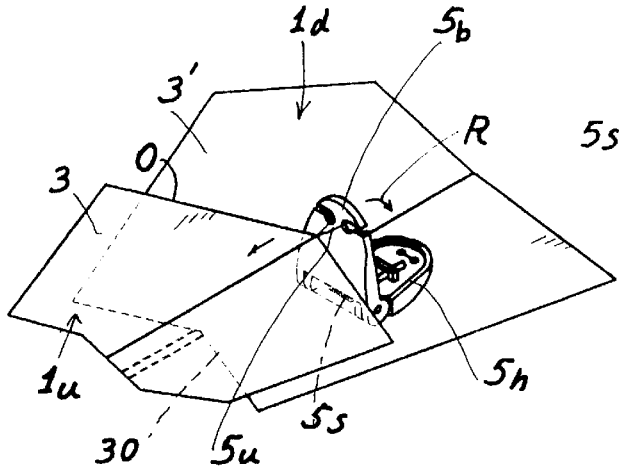
Fig. 14
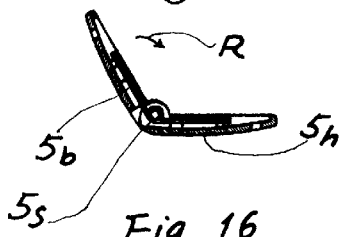
Fig. 16

ECONOMIC DOUBLE-STORY UMBRELLA AS CONVENIENTLY ANCHORED

This application is an improvement of U.S. Pat. No. 6,390,108 entitled "Economic Double-Story Umbrella" filed on Feb. 16, 2001.

BACKGROUND OF THE INVENTION

The prior application disclosed a double-story umbrella having an upper umbrella cloth 3 and a lower umbrella cloth 3' coupled each other by a plurality of buckling means 5*a*. However, there is not provided with any automatic restoring mechanism for automatically closing the upper umbrella cloth 3 on the lower umbrella cloth 3' whenever a strong wind is gone.

Meanwhile, the prior application did not disclose a supporting means for anchoring the central shaft of the umbrella on a ground.

The present inventor has found the drawbacks of the prior application and invented the present double-story umbrella which is conveniently anchored.

SUMMARY OF THE INVENTION

The object of the present invention is to provide a double-story umbrella including an upper umbrella formed by an upper umbrella cloth; a lower umbrella having a shaft and a rib assembly pivotally secured to the shaft for securing a lower umbrella cloth on the rib assembly; a plurality of detachable restorable buckling devices each coupling the upper umbrella cloth with the lower umbrella cloth; and a supporting device adjustably detachably secured on a lower portion of the shaft and operatively anchored on or under a ground for stably erecting the shaft and the double-story umbrella.

BRIEF DESCRIPTION OF THE DRAWINGS

FIG. 13 shows another preferred embodiment of the buckling means as modified from FIG. 8.

FIG. 14 shows the opening of the upper and lower umbrella cloths from FIG. 13.

FIG. 15 shows the buckling means when opening the upper and lower cloths as shown in FIG. 14.

FIG. 16 is a sectional drawing of the buckling means of FIG. 15.

DETAILED DESCRIPTION

As shown in FIGS. 1~12, a double-story umbrella of the present invention comprises: an upper umbrella 1*u*; a lower umbrella 1*d*; a plurality of detachable restorable buckling means 5*a* each coupling the upper umbrella 1*u* with the lower umbrella 1*d*; and an adjustable foldable supporting means 100 adjustably secured on a central shaft 1 for erecting the double-story umbrella. The supporting means 100 may be folded towards the central shaft 1 or may be detached from the shaft 1.

Figures 2, 3:
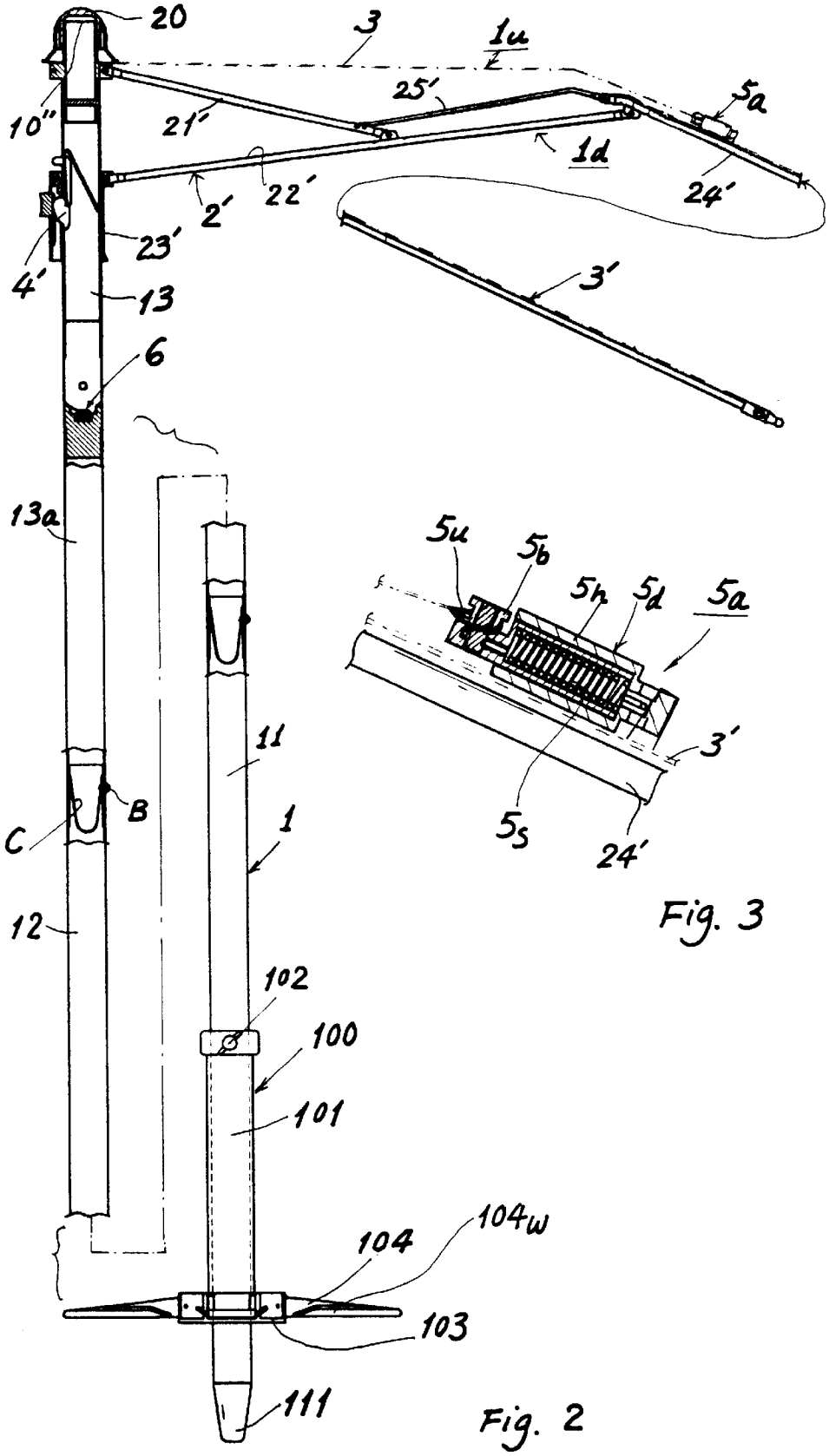
FIG. 2 is a partial sectional drawing of the present invention when opened.
FIG. 3 is an enlarged illustration of the restorable buckling means from FIG. 2.

The lower umbrella 1*d* includes: a central shaft 1, a lower rib assembly 2' pivotally secured to the shaft 1, a lower umbrella cloth 3' secured to the lower rib assembly 2', and a lower spring catch 4' resiliently lockable on the shaft 1 for locking the lower rib assembly 2' at its opening state as shown in FIG. 2.

The lower rib assembly 2' may be single fold or multiple folds. The rib assembly 2' as shown in the drawing figures includes: an inner rib 21' pivotally secured to a notch 20' formed on a top of the shaft 1, a lower stretcher rib 22' pivotally secured to a lower runner 23' slidably held on the shaft 1 and lockable on the shaft 1 by the lower spring catch 4' when opening the umbrella, and a lower tail rib 24' pivotally secured to an outer end of the stretcher rib 22' and having an innermost end of the tail rib 24' pivotally secured to the inner rib 21' by an auxiliary rib 25'; having an outermost end of the inner rib 21' pivotally secured to the stretcher rib 22'.

Figure 4:
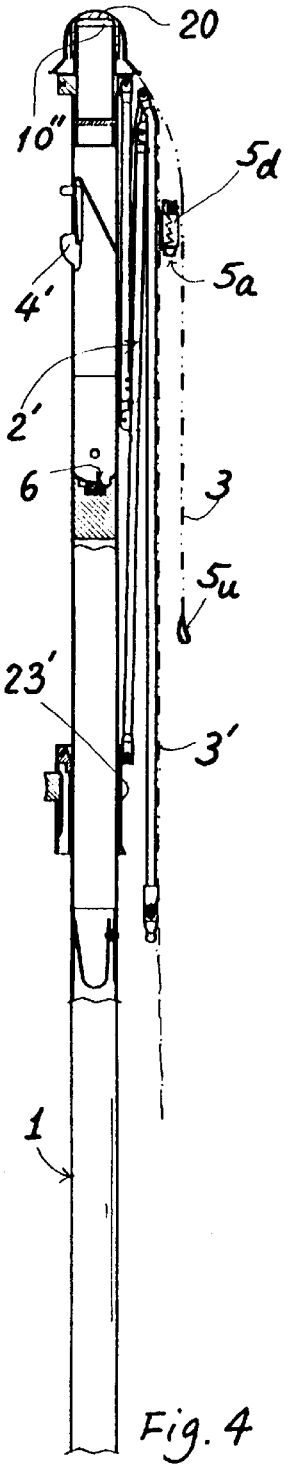
FIG. 4 shows a folded umbrella.

The upper umbrella 1*u* includes: an upper umbrella cloth 3 having its central portion secured, fastened or formed on a top 10" of the shaft 1 (as shown in FIGS. 2, 4) by a cap 20; and a plurality of upper buckling members 5*u* radially formed on an outer periphery of the upper umbrella cloth 3 and each engageable with a lower buckling member 5*d* formed on the lower umbrella cloth 3', with each upper buckling member 5*u* and each lower buckling member 5*d* forming a detachable restorable buckling means 5*a* in accordance with the present invention. The plurality of detachable restorable buckling means 5*a* are radially disposed on the umbrella cloths 3, 3'.

The central shaft 1 includes: a lower tube 11, a central shaft 12, and an upper tube 13 telescopically engageable with one another. Every two neighboring tubes are coupled by a U-shaped coupling C having a ball B for locking the two tubes when engaged and coupled together (FIG. 2).

An angle-adjusting means 6 (FIG. 2) is provided to pose or tilt the upper tube 13 on a tube section 13*a* to a desired angle (not shown) between the upper tube 13 and the tube section 13*a*.

As shown in FIGS. 3 and 5~9, each detachable restorable buckling means 5*a* includes: an upper buckling member 5*u* formed as a loop and secured on the upper umbrella cloth 3, and a lower buckling member 5*d* formed on an inner periphery of the lower umbrella cloth 3' adjacent to a central opening 30 of the lower cloth 3'; with each lower buckling member 5*d* corresponding to and engageable with each upper buckling member 5*u*.

Figure 5:
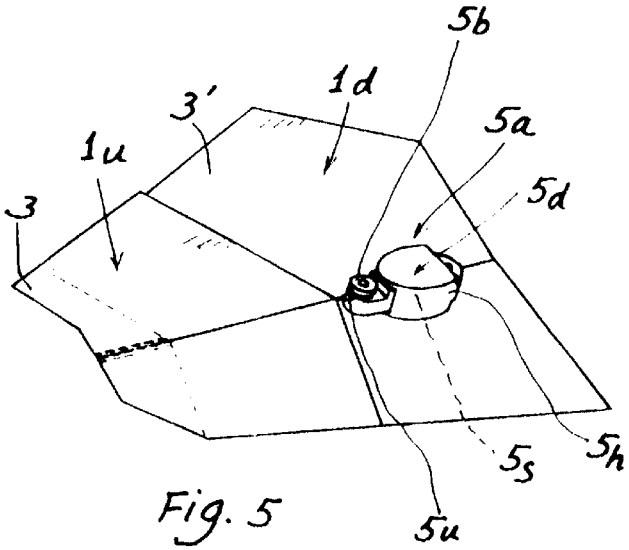
FIG. 5 shows the upper umbrella cloth restored to close the lower umbrella cloth by the restorable buckling means.
Figure 6:
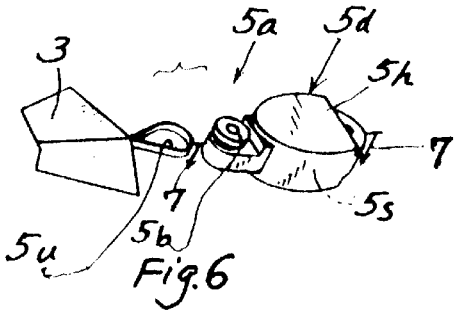
FIG. 6 further shows the coupling of the buckling means from FIG. 5.
Figure 7:
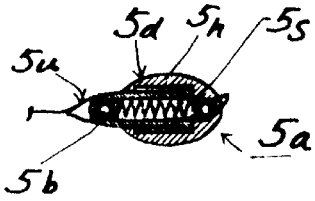
FIG. 7 is a sectional drawing as viewed from 7—7 direction of FIG. 6.
Figure 8:
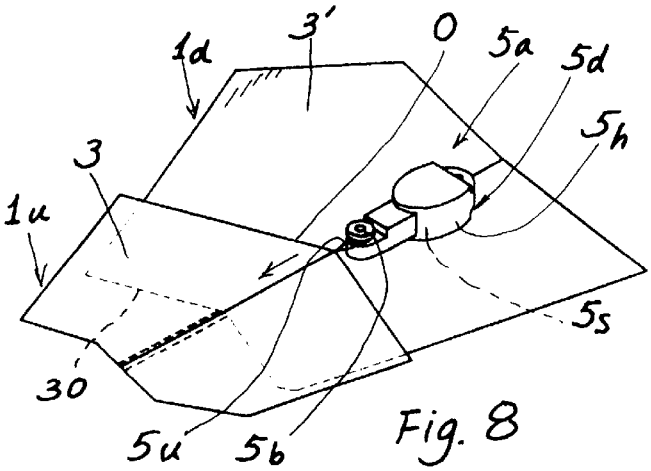
FIG. 8 shows the opening upper and lower umbrella cloths and the buckling means of the present invention.
Figure 9:
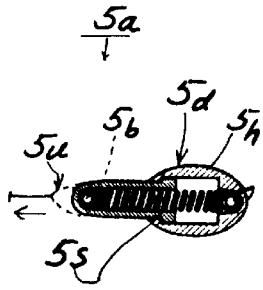
FIG. 9 is a sectional drawing of the buckling means from FIG. 8.

The lower buckling member 5*d* includes: a button 5*b* detachably engageable with the loop of the upper buckling member 5*u*, a restoring spring 5*s* having a first spring end secured to the button 5*b*, and a base holder 5*h* secured on the lower umbrella cloth 3' having the button 5*b* slidably engageable in the base holder 5*h* and having a second spring end of the restoring spring 5*s* secured to the base holder 5*h*; whereby upon blowing of a strong wind, the upper cloth 3 will be opened from the lower cloth 3' to form an opening 0 between the two cloths 3, 3' for releasing the wind and the upper buckling member 5*u* will pull the restoring spring 5*s* to separate the upper buckling member from the base holder 5*h* for forming the opening 0 between the upper and lower cloths and also to store a restoring spring energy (a tension force) of the spring 5*s* (FIGS. 8, 9). Once the wind is gone, the restoring spring 5*s* will restore to pull back the button 5*b* to close the upper cloth 3 on the lower cloth 3' (FIGS. 5~7).

Such an automatic restoring effect of the buckling means 5*a* is not disclosed in the prior application (U.S. Ser. No. 09/784,155).

When folding the umbrella of the present invention from FIG. 2 to FIG. 4, the upper and lower buckling members 5*u*, 5*d* are uncoupled and the upper cloth 3 is downwardly pulled to be flattened and superimposed on the lower cloth 3'; the supporting means 100 folded and the tubes 11, 12, 13 dismantled; all elements being stored in a bag B (FIG. 12) for convenient handling or storage.

As shown in FIGS. 13~16, the lower buckling member 5*d* is modified to include: a button lid 5*b* engageable with the upper buckling member 5*u* formed as a loop, a base holder 5*h* secured to the lower umbrella cloth 3', and a torsional restoring spring 5*s* having a first spring end secured to the button lid 5*b* and having a second spring end secured to the base holder 5*h* for normally closing the button lid 5*b* on the base holder 5*h*, whereby upon blowing of strong wind, the button lid 5*b* will be upwardly pulled by the upper buckling member 5*u* of the upper cloth 3 to open the lid 5*b* from the base holder 5*h* to open the cloths 3, 3' (FIGS. 14~16) and also to store the restoring energy of the restoring spring 5*s*. Once the wind is gone, the restoring spring 5*s* will restore to close the lid 5*b* on the base holder 5*h* to close the upper cloth 3 on the lower cloth 3' (FIG. 13).

Figure 11:
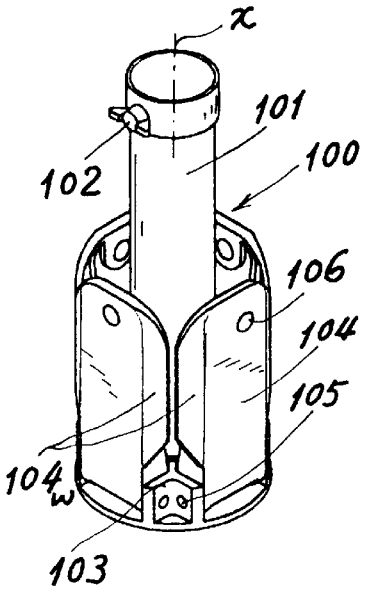
FIG. 11 shows the folded supporting means from FIG. 10.
Figure 10:
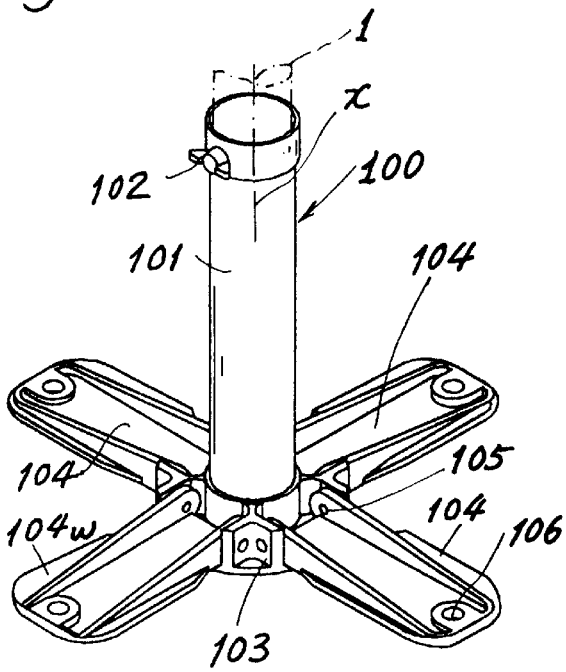
FIG. 10 shows a supporting means of the present invention when extended.
Figure 12:
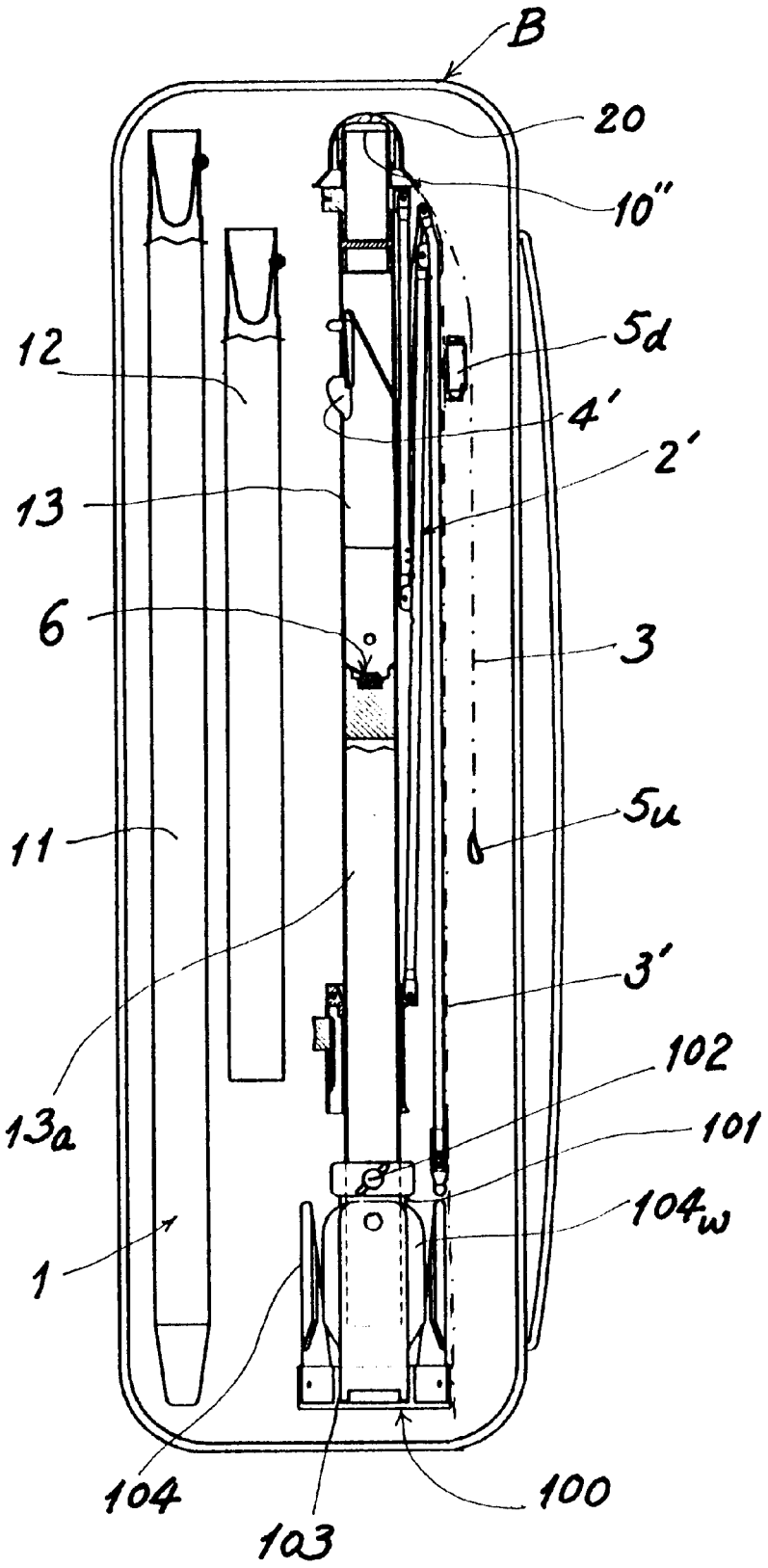
FIG. 12 shows a folded umbrella of the present invention as stored in a bag.

As shown in FIGS. 10, 11, the supporting means 100 includes: a sleeve 101 having a base 103 formed on a bottom portion of the sleeve 101, a plurality of supporting members 104 pivotally secured to the base 103, and an adjusting screw 102 rotatably mounted in the sleeve 101 for tightly fixing the sleeve 101 of the supporting means 100 on the central shaft 1 of the double-story umbrella or for loosening the sleeve 101 from the shaft 1 for detaching the supporting means 100 from the shaft 1.

Each supporting member 104 has its inner end portion pivotally secured to the base 103 by a pivot 105, and an outer end portion of the supporting member 104 formed with a fixing hole 106 to be fixed on a ground such as by a nail or by a fastening wire.

Each supporting member 104 is generally formed as a flat plate having a recess or hollow portion formed in an upper surface for saving material, decreasing weight and providing space for accommodating the screw 102 or other parts; having at least a side wing portion 104*w* circumferentially formed on a side edge of the supporting member 104 to increase the area when loaded with soil or sand on the supporting member 104 such as when anchored underground or in a soil layer in a beach, thereby enhancing the stability when erecting the umbrella.

When extending the supporting members 104 to be laid on a ground as shown in FIG. 10, the shaft 1 will be stably, conveniently erected as supported by the supporting means 100. When not in use, the supporting members 104 are folded towards the shaft 1 to minimize the folding volume for a convenient handling or storage with compact appearance of the folded umbrella to be superior to any prior umbrella.

Figure 1:
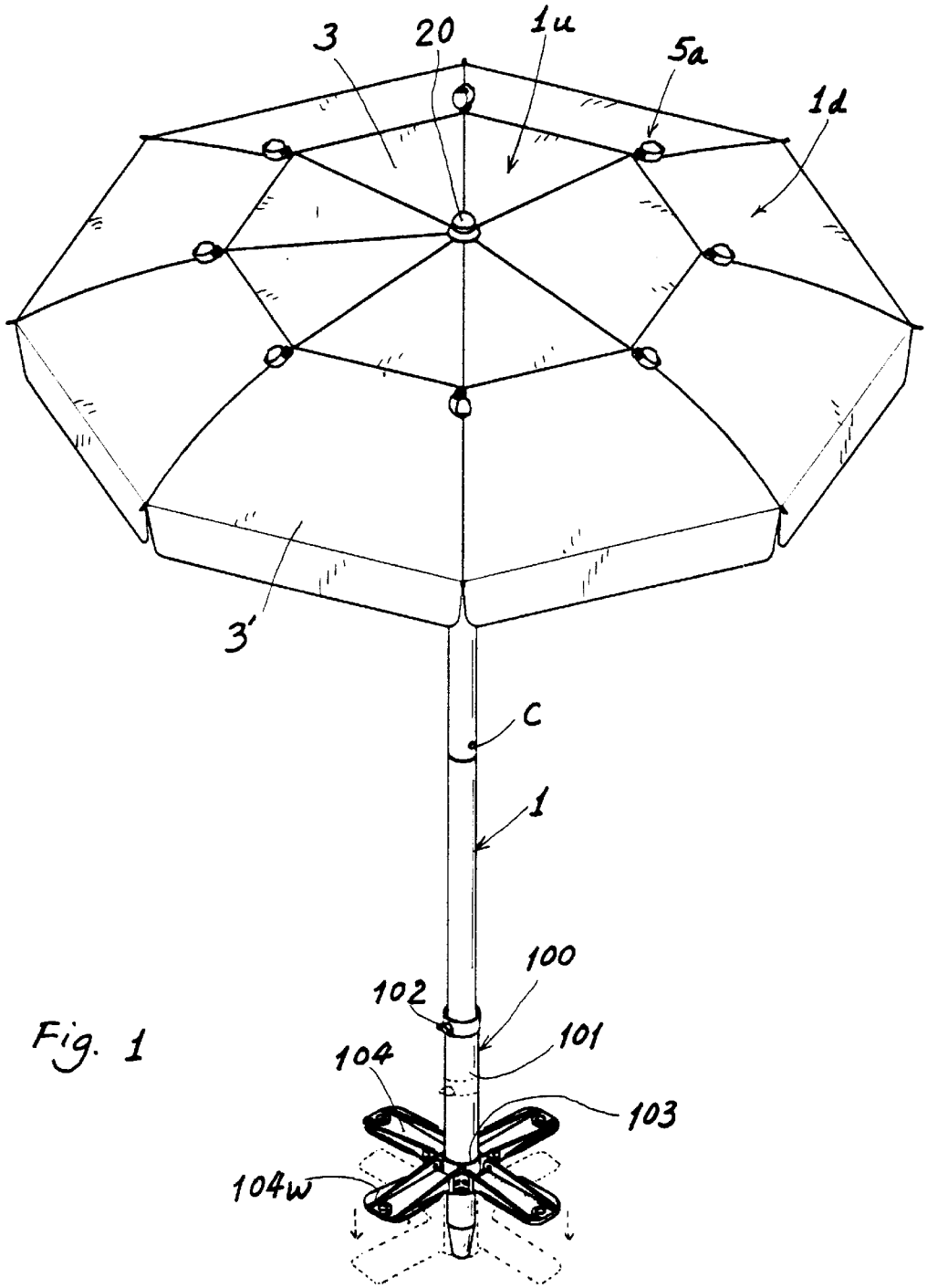
FIG. 1 is an illustration showing an opening umbrella of the present invention.

As shown in FIGS. 1, 2, a bottom probe portion 111 of the shaft 1 may be inserted into ground (soil) by downwardly protruding the probe portion 111 through the supporting means 100 as shown in solid line of FIG. 1 for helping stabilize the erection of the shaft 1 and the umbrella. Or, the probe portion 111 may be retracted into the sleeve 101 of the supporting means 100 as shown in dotted line of FIG. 1 and in FIG. 10 to allow the supporting means 100 to be laid on the ground surface.

Figure 18:
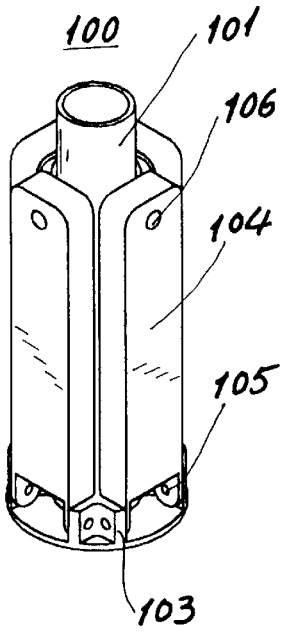
FIG. 18 shows the supporting means as folded from FIG. 17.
Figure 17:
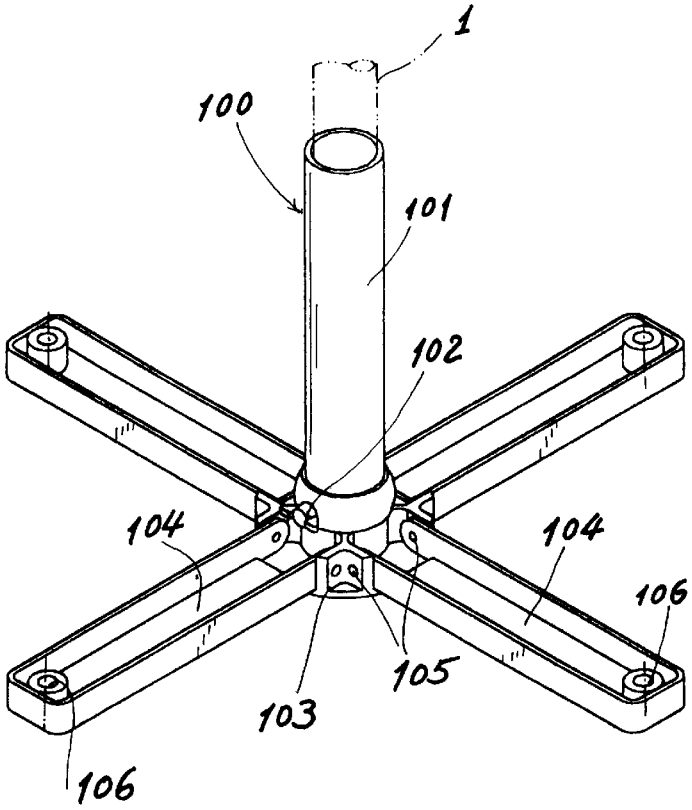
FIG. 17 shows another extended supporting means of the present invention.

As shown in FIGS. 17, 18, the side wing portion 104*w* has been eliminated from FIG. 10 to be another modification of the supporting means 100, and the screw 102 is also moved to a lower portion of the sleeve 101.

Figure 20:
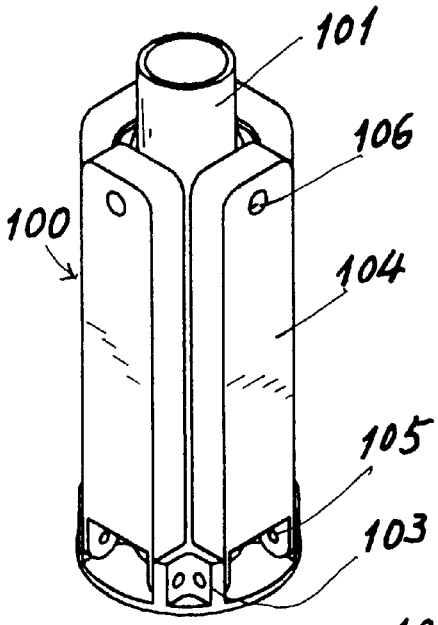
FIG. 20 shows the supporting means as folded from FIG. 19.
Figure 19:
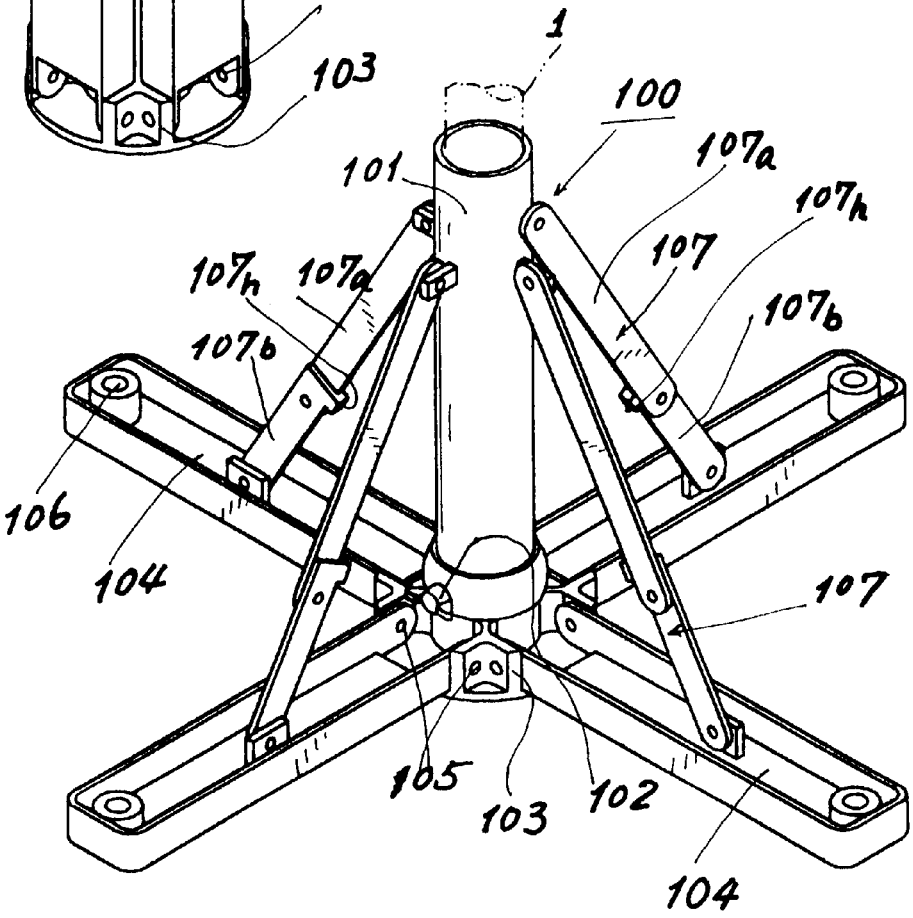
FIG. 19 shows further extended supporting means of the present invention.

As shown in FIGS. 19, 20, each supporting member 104 is pivotally secured to an upper portion of the sleeve 101 by a link 107 which can be single fold or multiple folds.

As shown in FIG. 19, each link 107 includes: a first link section 107*a* and a second link section 107*b* pivotally connected together, with a hook portion 107*h* formed on one said link section (e.g. the second link section 107*b*) for locking the other link section when linearly extended when extending the supporting member 104.

Figure 22:
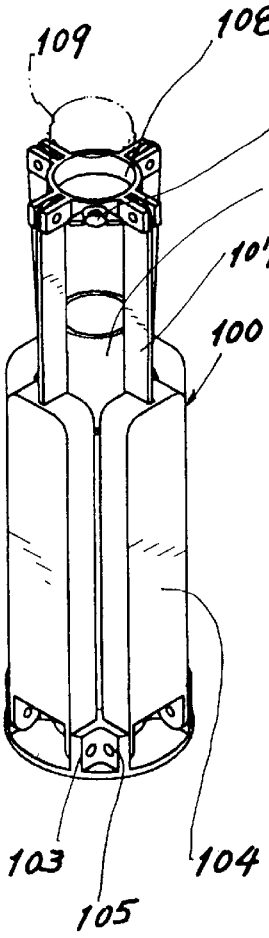
FIG. 22 shows the supporting means as folded from FIG. 21.
Figure 21:
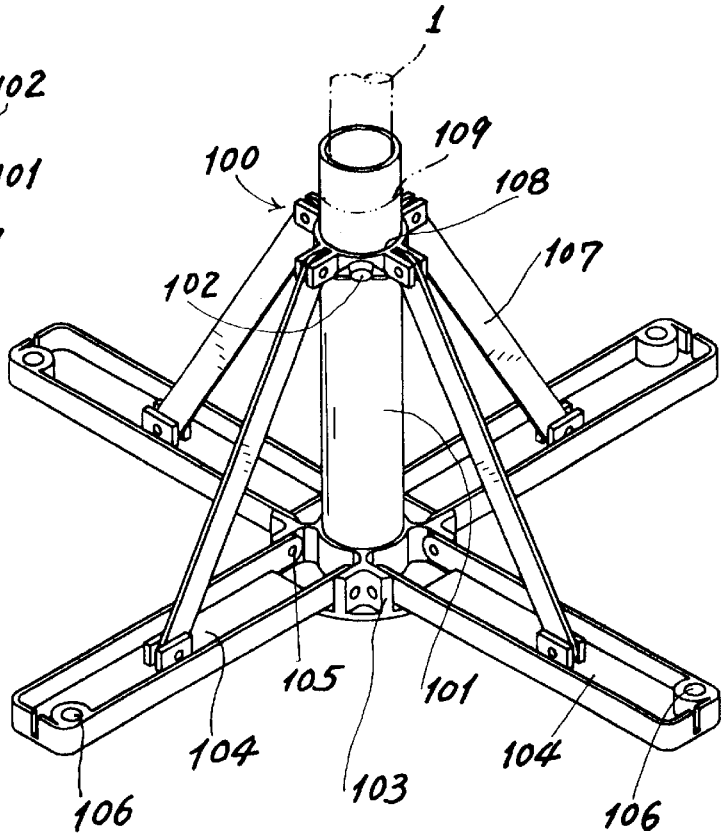
FIG. 21 shows still further embodiment of a supporting means as extended.

As shown in FIGS. 21, 22, each link 107 has its inner end pivotally connected to a bottom ferrule 108 of a bottom runner 109 slidably held on the sleeve 101 disposed about the shaft 1. The ferrule 108 may be fixed on the shaft 1 by locking the screw 102 as rotatably mounted in the ferrule 108. The screw 102 may also be loosened to unlock the ferrule 108 from the sleeve 101 and from the shaft 1 for folding the supporting members 104 towards the shaft 1.

According to the present invention, the upper cloth 3 is coupled to the lower cloth 3' by the buckling means 5*a* so as to save any fastening device including thread or wire to fasten the upper cloth 3 on the top rib 21' of the rib assembly 2'.

The present invention may be modified without departing from the spirit and scope of the present invention.

We claim:

1. A double-story umbrella comprising:

a lower umbrella including a central shaft, a lower rib assembly pivotally secured to the shaft and a lower umbrella cloth having a central opening formed therein and secured to the lower rib assembly;

an upper umbrella formed with an upper umbrella cloth secured to a top of said shaft;

a plurality of detachable restorable buckling means radially disposed on said upper and lower umbrella cloths, each said buckling means including an upper buckling member formed on an outer periphery of said upper umbrella cloth and a lower buckling member formed on an inner periphery of said lower umbrella cloth and engageable with said upper buckling member for coupling said upper umbrella cloth on said lower umbrella cloth; wherein each said detachable restorable buckling means including said upper buckling member; and said lower buckling member having a restoring spring resiliently retained between said upper and lower buckling members; whereby upon wind blowing, said upper buckling member will be upwardly pulled from the lower buckling member to open the upper umbrella cloth from the lower umbrella cloth; and upon releasing of wind, the restoring spring will restore the upper buckling member towards the lower buckling member to close the upper umbrella cloth on the lower umbrella cloth; and a supporting means including a sleeve adjustably detachably secured to a lower portion of said central shaft by an adjusting screw and including a plurality of supporting members operatively extended to be laid on a ground or anchored in a ground for stably erecting the shaft and the double-story umbrella; and upon folding of said plurality of supporting members towards said shaft, said supporting means will be folded for storage and handling.

2. An umbrella according to claim 1, wherein each said supporting member has its outer end portion pivotally secured to an upper portion of said sleeve by a link.

3. An umbrella according to claim 2, wherein each said link is selected from single fold and multiple folds.

4. An umbrella according to claim 2, wherein each said link of said supporting member is pivotally secured to a bottom ferrule slidably held on said sleeve.

5. An umbrella according to claim 1, wherein said upper buckling member is formed as a loop engageable with a button secured to a first spring end of said restoring spring; said lower buckling member having a base holder secured to the lower umbrella cloth for slidably holding said button in said base holder and for securing a second spring end of said restoring spring to said base holder.

6. An umbrella according to claim 1, wherein said lower buckling member includes a button lid engageable with said upper buckling member, a base holder secured to the lower umbrella cloth, and said restoring spring having a first spring end secured to said button lid and having a second spring end secured to the base holder; whereby upon wind blowing, said button lid will be opened from said base holder to open the upper umbrella cloth from the lower umbrella cloth; and upon wind releasing, said restoring spring will restore to close said button lid on said base holder to close the upper umbrella cloth on the lower umbrella cloth.

* * * * *